US010286368B2

(12) United States Patent
Deshpande

(10) Patent No.: US 10,286,368 B2
(45) Date of Patent: May 14, 2019

(54) MIXING DEVICE WITH ANTI-SPOILAGE MONITOR

(71) Applicant: Smita Deshpande, Cambridge, MA (US)

(72) Inventor: Smita Deshpande, Cambridge, MA (US)

( * ) Notice: Subject to any disclaimer, the term of this patent is extended or adjusted under 35 U.S.C. 154(b) by 84 days.

(21) Appl. No.: 15/278,264

(22) Filed: Sep. 28, 2016

(65) Prior Publication Data

US 2017/0087524 A1 Mar. 30, 2017

Related U.S. Application Data

(60) Provisional application No. 62/284,324, filed on Sep. 28, 2015.

(51) Int. Cl.

| | |
|---|---|
| ***B01F 13/00*** | (2006.01) |
| ***B01F 15/00*** | (2006.01) |
| ***B01F 15/02*** | (2006.01) |
| ***B65D 25/08*** | (2006.01) |
| ***B65D 79/02*** | (2006.01) |
| ***B65D 81/32*** | (2006.01) |

(52) U.S. Cl.

CPC .... *B01F 13/0022* (2013.01); *B01F 15/00512* (2013.01); *B01F 15/0215* (2013.01); *B65D 25/08* (2013.01); *B65D 79/02* (2013.01); *B65D 81/32* (2013.01)

(58) Field of Classification Search

CPC ..... B01F 13/0022; B01F 15/00512; B01F 15/0215; B65D 25/08; B65D 79/02; B65D 81/32

See application file for complete search history.

(56) References Cited

U.S. PATENT DOCUMENTS

| | | | |
|---|---|---|---|
| 3,156,369 | A | 11/1964 | Bowes et al. |
| 4,361,408 | A | 11/1982 | Wirtschafter |
| 4,779,722 | A | 10/1988 | Hall |
| 5,233,571 | A | 8/1993 | Wirtschafter |
| 5,275,298 | A | 1/1994 | Holley, Jr. et al. |
| 5,313,439 | A | 5/1994 | Albeck |
| 5,433,328 | A | 7/1995 | Baron et al. |

(Continued)

FOREIGN PATENT DOCUMENTS

| | | |
|---|---|---|
| WO | WO2012149605 | 11/2012 |
| WO | WO2014180173 A1 | 11/2014 |

*Primary Examiner* — Anshu Bhatia
(74) *Attorney, Agent, or Firm* — PATENTEC

(57) ABSTRACT

System and method for enabling accurate spoilage monitoring of a liquid food product or the like from the moment it is created, until the time it is either consumed or needs to be discarded. In a preferred embodiment of the invention, a container for the food product, or a device to be attached to a container, is equipped with a switch, thermometer, other environmental sensors, controller and alarm. The switch is activated automatically or manually at the moment when the liquid food product is created, and then the temperature and other environmental parameters of the food product are monitored during the subsequent course of time, all the while keeping track of the temperature history of the product throughout the period, until the controller calculates that the maximum safe period has expired; whereupon an alarm is activated to warn the user to discard the product.

21 Claims, 2 Drawing Sheets

(56) References Cited

U.S. PATENT DOCUMENTS

| | | | | |
|---|---|---|---|---|
| 5,442,669 | A | 8/1995 | Medin | |
| 5,798,694 | A | 8/1998 | Reber et al. | |
| 5,863,126 | A | 1/1999 | Guild | |
| 5,984,141 | A | 11/1999 | Gibler | |
| 6,202,540 | B1 | 3/2001 | Johnson et al. | |
| 6,664,887 | B1 | 12/2003 | Fuchs | |
| 6,705,491 | B1 | 3/2004 | Lizerbram et al. | |
| 6,795,376 | B2 | 9/2004 | Quine | |
| 6,945,393 | B2 | 9/2005 | Cho | |
| 6,985,408 | B2 | 1/2006 | Quine | |
| 7,061,832 | B1 | 6/2006 | Lansing | |
| 7,070,046 | B2 | 7/2006 | Cho | |
| 7,150,369 | B1 | 12/2006 | Fryar | |
| 7,212,955 | B2 | 5/2007 | Kirshenbaum et al. | |
| 7,331,478 | B2 | 2/2008 | Aljadi | |
| 7,360,369 | B2 | 4/2008 | Tamborra | |
| 7,464,811 | B2 | 12/2008 | Patterson et al. | |
| 7,484,633 | B1 | 2/2009 | Moher | |
| 7,495,558 | B2 | 2/2009 | Pope et al. | |
| 7,523,823 | B1 | 4/2009 | Bednar | |
| 7,604,398 | B1 | 10/2009 | Akers et al. | |
| D606,661 | S | 12/2009 | Colombo | |
| 7,675,409 | B2 | 3/2010 | Jensen et al. | |
| 7,675,424 | B2 | 3/2010 | Debord et al. | |
| 7,850,027 | B2 | 12/2010 | Hayes et al. | |
| 7,874,420 | B2 | 1/2011 | Coon | |
| 7,896,180 | B2 | 3/2011 | Kenney | |
| 7,909,160 | B2 | 3/2011 | Patterson et al. | |
| 7,992,735 | B2 | 8/2011 | Bullard et al. | |
| 8,018,347 | B2 | 9/2011 | Tehrani et al. | |
| 8,146,758 | B1 | 4/2012 | Peres | |
| 8,267,276 | B2 | 9/2012 | Francomano | |
| D668,972 | S | 10/2012 | Solly et al. | |
| 8,371,440 | B2 | 2/2013 | Questad et al. | |
| 8,413,803 | B2 | 4/2013 | Questad et al. | |
| D683,037 | S | 5/2013 | Questad et al. | |
| 8,459,450 | B1 | 6/2013 | Whitaker et al. | |
| 8,474,611 | B2 | 7/2013 | Marco | |
| 8,490,803 | B2 | 7/2013 | Harris | |
| 8,556,094 | B2 * | 10/2013 | Brown | A61J 1/2093 206/219 |
| 8,672,123 | B1 | 3/2014 | Vallejo et al. | |
| 8,717,182 | B1 | 5/2014 | Brashears et al. | |
| 8,747,775 | B2 | 6/2014 | Sandvick | |
| 8,783,452 | B2 | 7/2014 | Thoman et al. | |
| 8,820,549 | B1 * | 9/2014 | Estrada | A61J 9/001 215/11.3 |
| 9,004,301 | B2 | 4/2015 | Wahlstrom | |
| 9,016,193 | B2 | 4/2015 | Minvielle | |
| 9,067,715 | B2 | 6/2015 | Lee et al. | |
| 9,121,840 | B2 | 9/2015 | Minvielle | |
| 9,134,288 | B1 | 9/2015 | Ettinger | |
| 9,244,440 | B2 | 1/2016 | Pantchenko | |
| 2004/0149599 | A1 | 8/2004 | Cho | |
| 2007/0091726 | A1 | 4/2007 | Stauffer et al. | |
| 2008/0087622 | A1 | 4/2008 | Dowd | |
| 2009/0178940 | A1 | 7/2009 | Said | |
| 2009/0283536 | A1 | 11/2009 | Libby | |
| 2010/0213085 | A1 | 8/2010 | Belnap | |
| 2012/0218105 | A1 | 8/2012 | Chang | |
| 2014/0190357 | A1 | 7/2014 | Mak | |
| 2015/0153239 | A1 * | 6/2015 | Pantchenko | G01N 33/04 374/142 |
| 2015/0245743 | A1 | 9/2015 | Rosenfeld | |
| 2015/0307245 | A1 | 10/2015 | Puccini | |

* cited by examiner

MIXING DEVICE WITH ANTI-SPOILAGE MONITOR

CROSS REFERENCE TO RELATED APPLICATIONS

This application claims benefit of U.S. Provisional Patent Application 62/284,324 filed on Sep. 28, 2015, the entire content and substance of which is also incorporated herein by reference.

TECHNICAL FIELD OF THE INVENTION

This invention relates to the field of liquid food dispensing apparatus, and in particular to food dispensing involving mixing of food components within a dispensing container and which may be subject to spoilage based on extended exposure to environmental conditions. The invention has particular benefit for mixing and monitoring of baby formula in a baby bottle.

BACKGROUND OF THE INVENTION

There are many situations where it is desirable to store the components of liquid food in separate containers or compartments within a container until the time when it is desired to consume them. One of the most common of these situations involves feeding babies with baby formula mixed with water. In the past, it has been common to fill a baby bottle with water, open a package of powdered formula and pour it into the bottle, and then agitate the contents until the ingredients are thoroughly mixed. However, once mixed, the liquid formula must be consumed within a short period of time, typically within two hours, or the mixture will be spoiled. The length of time that the mixture can be stored depends, in part, on the temperature of the mixture during the course of being used, which can in turn vary depending on ambient environmental conditions. For example, it is common to heat the water either before mixing or after mixing to bring the temperature closer to the body temperature of the baby. Or, the bottle may be set down for a period of time, or placed in a refrigerator for a period of time. In addition, when the bottle is not in use, the ambient air temperature around the bottle may vary, for example if the baby is fed inside the house or outside on a cold or hot day. Because pathogens grow faster in warmer temperatures, these varying and unpredictable temperatures can affect the length of time for which the mixture is usable.

Unfortunately, it is difficult to know the point in time when the mixture becomes spoiled and should be discarded, because it is relatively easy to forget exactly when the formula was mixed, and how much time has elapsed since then, and also because it is also difficult to factor in the variable temperatures that the bottle has experienced during that time. Accordingly, as a precaution, unused food may be unnecessarily disposed of too early, or worse, a baby may be exposed to spoiled formula if the acceptable usage time is overestimated.

In the past, the desire to have more accurate awareness of the time that baby milk remains in the bottle has led to a number of inventions relating to timers associated with baby bottles. An example of the prior art may be seen in U.S. Pat. No. 9,244,440 to Pantchenko, the entire contents of which is herein incorporated by reference. This patent teaches a device that may be affixed to the outside of a bottle by a band or the like, for monitoring the time and temperature that the bottle experiences since the most recent time that the device was reset. The device calculates various display values, such as the current time, current temperature, current expiration time, etc. and may selectively display these values on a display screen. The device may further take a temperature measurement and calculate a time interval corresponding to the temperature reading, and may trigger an alarm based on the elapsed time or the temperature or change in temperature.

The problem of accurately assessing the expiration date of perishable goods has been widespread throughout the food industry. An example of the prior art with respect to temperature and time monitoring of perishable food items may be found in U.S. Pat. No. 6,795,376 to Quine, the entire contents of which is herein incorporated by reference. The system taught in this patent is an LCD device mountable on a package of perishable food, and including a controller and one or more sensors, which may monitor temperature, humidity, pressure, pH, ambient light, or mechanical situations using trip wires or switches. Based on the sensor signals, the controller adjusts the expiration date shown on the LCD display, by determining whether an environmental triggering condition has occurred that necessitates an adjustment to the expiration date, or by causing the expiration clock to run backwards at a rate that is determined in accordance with tables and/or logic preprogrammed into the controller. The rate of change of the expiration date can be made to be proportional to, or otherwise a function of, the magnitude of the measured environmental condition away from a preferred environmental condition, which for simplicity may be taken to be a linear correlation. In operation, the expiration date is initially set to be the maximum amount, and various environmental conditions may then cause the controller to alter the expiration date to an earlier value. One such condition is whether a seal on the package has been opened, exposing the contents of the package to outside air (and biological contaminants). As taught in this patent, a conductive wire may be broken when the package is opened. The controller may then take appropriate action, such as shifting the expiration date to an earlier expiration date, and may subsequently use a different table or algorithm for computing further adjustments to the expiration date based on environmental conditions experienced later.

Another example of a prior art monitor designed to be attached to a perishable food product and which calculates an expiration date in part based on ongoing environmental conditions such as temperature, is U.S. Pat. No. 7,495,558 to Pope et al, the entire contents of which is herein incorporated by reference. The calculation of expiration date may be based in part on a spoilage curve derived from the Arrhenius kinetic equation, for example wherein spoilage rate is equal to a linear function of inverse exponential temperature. The monitor is configured to periodically measure one or more average or estimated temperatures over a time period since a previous measurement. The temperature measurements are then used to determine whether the product remains fresh, for example from a table of data and including an integration calculation over time.

With respect to baby bottles that are designed to enable rapid mixing of powdered baby formula with water, the prior art includes specialized bottles that have a main chamber holding water, and a second chamber holding the powdered formula to be mixed, which is initially maintained closed with respect to the first chamber. Mixing occurs by moving an external actuating element that breaks a seal or opens a valve enabling the powder and water to come in contact. For example, in U.S. Pat. No. 2,786,769 to Greenspan (the entire contents of which are herein incorporated by reference), the actuating element is a plunger which forces open a seal; and for U.S. Pat. No. 8,413,803 to Questad et al (the entire contents of which are also herein incorporated by reference), the actuating element is a plunger which can be moved by pressing on the flexible bottom of the bottle, thereby forcing open a valve at the other end of the plunger. Other examples of patents teaching bottles designed to allow isolated storage and subsequent mixing of contents, using a variety of storage chamber means and sealing means, are the following, the entire contents of which are also herein incorporated by reference:

| | |
|---|---|
| D606661 | Elizabeth Colombo |
| 20040149599 | Young Cho |
| 9067715 | Jeong-min Lee et al |
| 9004301 | Matthew Wahlstrom |
| 8820549 | Christopher Estrada |
| 8783452 | Federico Thoman et al |
| 8672123 | Mario Vallejo et al |
| 8556094 | Jeddah B Brown et al |
| 8474611 | Saulle Marco |
| 8459450 | Kevin Whitaker et al |
| 8267276 | Joel Francomano |
| 8146758 | Travis Peres |
| 7909160 | Brent Patterson et al |
| 7896180 | Michael Kenney |
| 7874420 | Darren Coon |
| 7850027 | Scott H. Hayes et al |
| 7523823 | Thomas R. Bednar |
| 7484633 | Laura E. Moher |
| 7464811 | Brent Patterson et al |
| 7331478 | Selma E. Aljadi |
| 7150369 | Kimberly C. Fryar |
| 7070046 | Young Kook Cho |
| 6945393 | Young Kook Cho |
| 6705491 | Eric K. Lizerbram et al |
| 5984141 | Gregory A. Gibler |
| 5863126 | William Guild |
| 5433328 | Moises S. Baron et al |
| 5275298 | James W. Holley, Jr. et al |
| 4779722 | John E. Hall |
| 3156369 | Donald R Bowes et al |

SUMMARY OF THE INVENTION

The present invention comprises in its principal embodiments, a system and method for enabling accurate spoilage monitoring of a liquid food product from the moment it is created, until the time it is either consumed or needs to be discarded. In a preferred embodiment of the invention, a container for the food product, or a device desired to be attached to a container, is equipped with a switch, thermometer and/or other environmental sensors, controller and alarm. The switch is activated automatically or manually at the moment when the liquid food product is created, and then the temperature and possible other environmental parameters of the food product are monitored during the subsequent course of time, all the while keeping track of the temperature history of the product throughout the period, until the controller calculates that the maximum safe period has expired; whereupon an alarm is activated to warn the user to discard the product.

DETAILED DESCRIPTION

Figure 1:
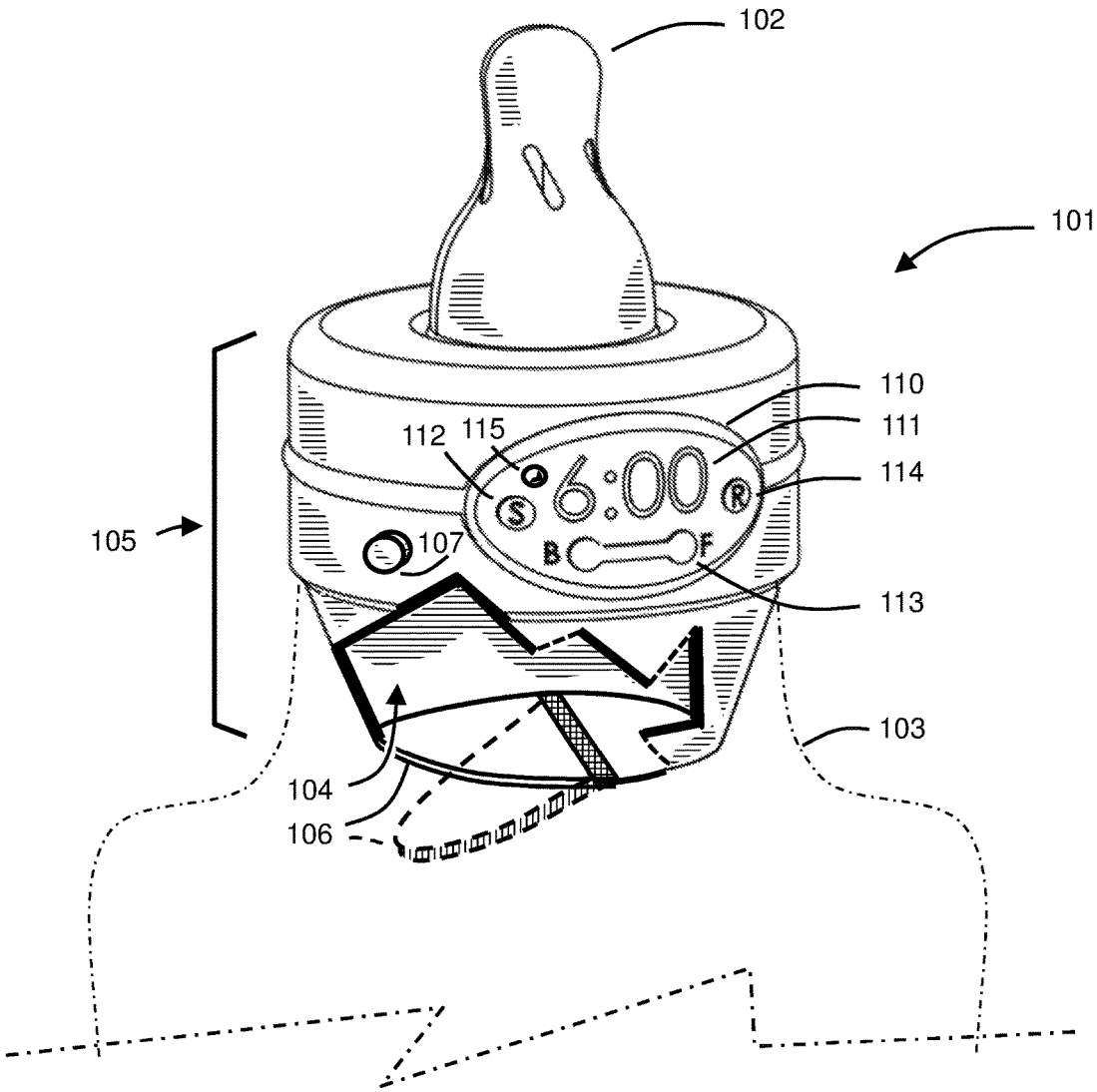
FIG. 1 shows in a preferred embodiment the mixing and spoilage monitor of the instant invention installed on a conventional baby bottle.

FIG. 1 shows a preferred embodiment of the instant invention, wherein the mixer and spoilage monitor is presented in the form of an enhanced bottle ring 101 that can be installed along with a conventional nipple 102 on a conventional baby bottle 103 (shown in outline), thereby forming a container that can hold a liquid such as water. However, unlike a conventional baby bottle ring, the enhanced ring of the instant invention includes an interior compartment 104 extending within at least a portion of the general area indicated as 105 in FIG. 1, and capable of holding formula (not shown) ready to be mixed with the liquid that is held in bottle 103. Prior to mixing, the formula and liquid are held isolated by seal means 106 shown in cutaway view, and further illustrated here by way of example as a butterfly valve. Although a butterfly valve is shown, any other suitable seal means can be employed in the instant invention, including without limitation, poppet valves, pivoting members with aligning holes, frangible elements, etc. Indeed, as will be readily understood by those skilled in the art, although a particular construction for the storage chamber, seal and liquid chamber is illustrated in FIG. 1, the invention can work with many other sealing means, such as the diverse arrangements disclosed by example in the prior art listed above. Also shown in the particular embodiment of FIG. 1 is an external actuating element 107, which may be any type of mechanical element, including without limitation, a push button, sliding lever, etc. In some embodiments, external member 107 is linked internally to the seal 106 to cause the seal to be broken (in other words, in the case of a valve, for the valve to be opened, or in the case of a frangible element, for the element to be pierced or torn) when it is desired to mix the formula contents retained in compartment 104 with the liquid in bottle 103. In some embodiments, external member 107 may be replaced with just an electrical switch if the seal 106 is electrically actuated, as will be discussed hereinafter.

Figure 2:
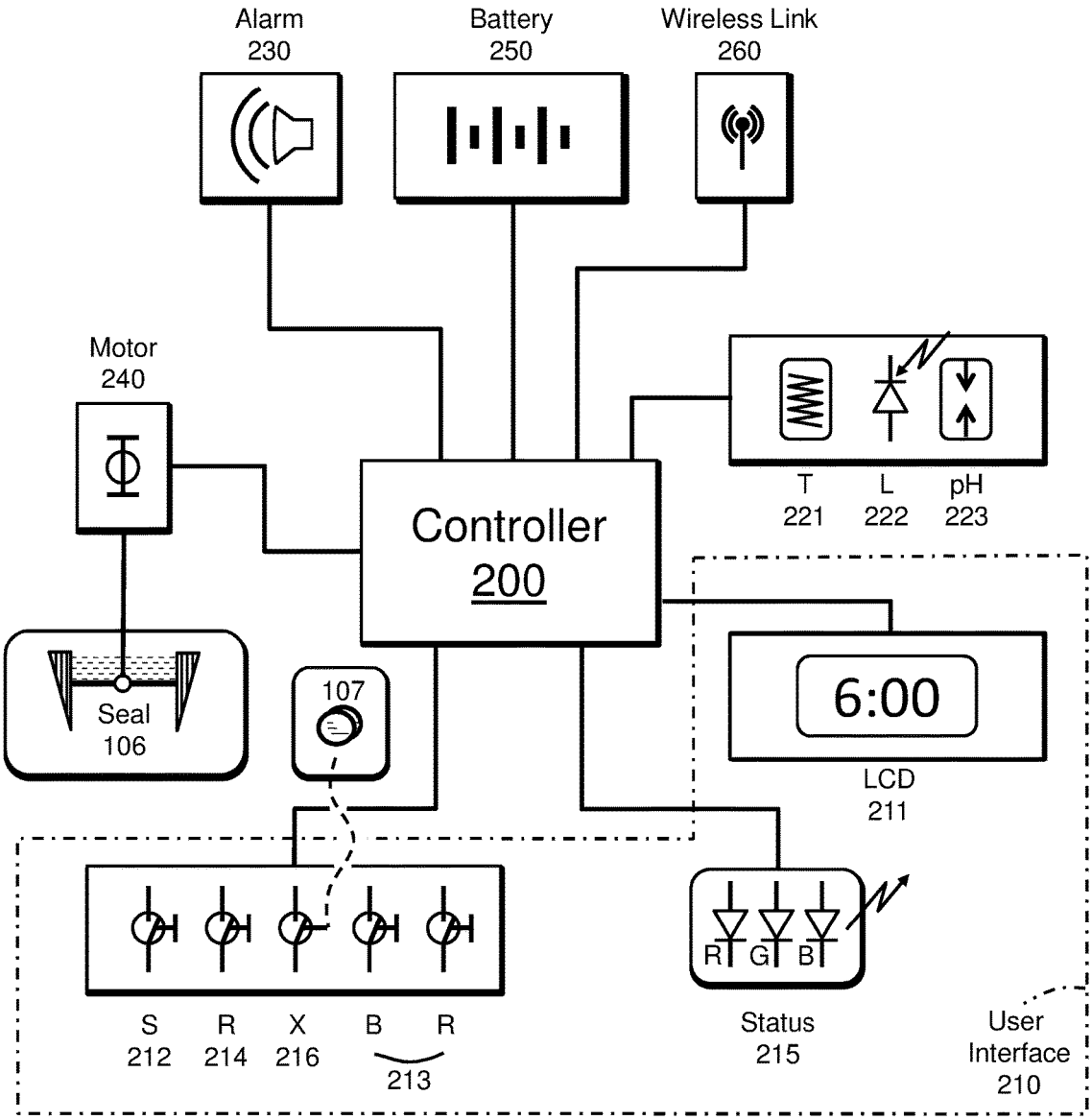
FIG. 2 shows in a preferred embodiment the electrical components of the mixing and spoilage monitor of the instant invention.

The mixer and spoilage monitor of a preferred embodiment of the instant invention may be further understood with reference to FIG. 2 in association with FIG. 1, wherein FIG. 2 shows in detail the electrical components for the preferred embodiment. The mixer and spoilage monitor includes digital controller 200 and associated user interface 210, also shown generally as 110 in FIG. 1. Also shown in FIGS. 2 and 1 are display (211, 111, respectively), which may comprise an LCD display or other electronic display, Start/Stop button (212, 112), Formula content selector (213, 113), Reset button (214, 114), and Status indicator (215, 115), which may be a multicolor LED or may be simply another display portion of LCD (211, 111), or other type of electronic display. FIG. 2 also shows audible alarm 230 which in some embodiments may be actuated when the controller indicates that the contents of the bottle are spoiled, and may also give audible feedback as the buttons 212, 214, etc. are pressed. Also shown is battery means 250 to provide power to the controller and other electronic components, and one or more environmental sensors 220 such as temperature 221, light 222, pH 223, etc. for providing a signal that the controller may use to more accurately determine spoilage. FIG. 2 also shows motor means 240 which may be used to automatically actuate seal 106 and switch 216 which may be used to sense movement of mechanical member 107 in the case where seal 106 is manually actuated. Also shown in FIG. 2 is wireless link means 260 to enable communication with an external device using well-known Wi-Fi, Bluetooth, etc. wireless communication means, if desired. There may also be an electrical socket (not shown) to allow connecting a source of electrical power to recharge battery 250 or provide electronic communication to an external device.

The operation of the preferred embodiment of the instant invention may be further understood with reference to FIGS. 2 and 1. Before ring 101 is installed on a baby bottle, compartment 104 is filled with the required amount of formula by first opening seal 106 either manually with actuator 107, or by actuating one or more electrical buttons (e.g., Start Button 212 combined with Reset Button 214) on the controller's user interface, or by filling from the top prior to installing nipple 102. Formula selector (213, 113) may be actuated to inform controller 200 about the particular formula contents installed. Then, bottle 103 is filled with the required amount of liquid, and ring 101 is installed on the bottle (usually by screwing it onto the opening, depending on the type of bottle to which it is designed to be attached). Seal 106 is then closed, either by pressing Reset Button 214 or by manually closing the seal, or in the case of a frangible seal, by installing a new frangible seal member. At this point, seal 106 maintains the liquid and formula in total isolation. This condition may be retained for a considerable period of time without worry of spoilage. However, it is also possible to place the controller in a first standby shelf-mode status to allow the controller to keep track of the length of time (and of environmental conditions—to be explained later), of the isolated formula/liquid compartments, if the condition is to be maintained for a sufficiently long time that shelf spoilage should be considered. This shelf mode may be indicated to the user by changing status indicator 115 for example to "blue" (by actuating the "B" LED), or by changing the display on LCD display (211, 111). The controller may then monitor the time and environmental conditions of the separated formula and liquid prior to the time they are mixed, and issue alarms in a manner similar to the process described below for monitoring the contents once mixing has occurred.

When it is desired to mix the formula, either external member 107 is actuated (for those embodiments that have a manual actuating member) to cause seal 106 to open; or start/stop button (212, 112) is actuated to cause the controller to actuate motor 240, thereby opening seal 106 or otherwise breaking the seal, for example by piercing or tearing it if a frangible seal. In the case of actuation by external member 107, electrical switch 216 may also be actuated, automatically sending a "commencement of mixing" signal to the controller, or start/stop button (212, 112) may be actuated by the user to send the "commencement of mixing" signal.

Once seal 106 is opened, the liquid in bottle 103 and the formula in compartment 104 are no longer maintained in isolation, but are now in mutual association so that the formula may travel to the liquid and/or the liquid travel to the formula, and mixing can occur. To enhance mixing, the bottle may be agitated manually by shaking the entire bottle, or the internal movement may be imparted by further back-forth operation of seal 106, or if desired, by motion of additional internal elements such as mixing vanes (not shown). Responsive to the "commencement of mixing" signal, the controller is now placed in "active" mode, and status indicator 115 may change color (e.g., to "green" by actuating the "G" LED) to indicate the active mode status. Further, controller 200 now initiates a timer (which may be internal to controller 200), and actively monitors the timer and additional environmental parameters 220 to determine the safety of the mixed contents. During this time, the LCD display (211, 111) may display the allowable time left until spoilage, or may display other parameters, such as the temperature, formula content, etc. This display of various parameters can occur on a rotating basis, or may be selected by suitable user controls, such as combinations of the switches already described, or by additional switches (not shown) for selecting the parameter to display.

Eventually, either the contents of bottle 103 are consumed, in which case the user can press Reset button 214 to stop the controller and cancel further monitoring, or the controller reaches the point in its spoilage calculation where it believes the contents are in danger. This can occur because the calculated elapsed growth of pathogens within the container has reached a threshold, or because a particular condition is measured (e.g., pH or other chemical sensor, beyond limits). The controller may then actuate alarm 230, change the color of status indicator (215, 115), e.g. to "red" (by actuating the "R" LED), and set the LCD to zero or some other suitable indicator of spoilage. Preferably, prior to reaching the status of "spoiled", the controller may reach a point in its calculation where it believes the contents are "nearly spoiled". In such case, it can issue a preliminary warning alarm (e.g., short beeps) on alarm 230 and change the status indicator (215, 115), e.g., to "yellow" (for example, by actuating both the R and G LEDs simultaneously). Thus, in preferred operation, the status indicator (215, 115) can change from "green" to "yellow" to "red" to indicate sequentially that the contents are "good", "nearly spoiled", or "spoiled". Of course, other visual indicators are within the scope of the invention, such as a spaced series of three independent lights for these conditions, or particular indicia on the LCD screen, as is well-known by those skilled in the art of electronic user interfaces.

That environmental parameters may affect spoilage time for perishable goods is discussed above in reference to the prior art spoilage monitors. Of primary importance to the instant invention are temperature, light, and pH (and other chemical measurements), which may be derived from suitable electrical sensors 220-223 appropriately disposed with respect to the ring and bottle. The temperature measurement may be obtained from a temperature sensor 221 near the exterior of the bottle, or may be an internal sensor having a housing that contacts the mixed contents within the bottle. Similarly, the pH sensor 223 may comprise an electrical contact that can measure the pH within the bottle. Once in active mode (or while in stand-by shelf mode for those embodiments that make use of it) the controller uses the environmental measurements to calculate on a rapid and periodic basis (i.e., pseudo-continuously) the expected spoilage time for the current contents. The particular algorithm or table look-up used to calculate the spoilage as a function of environmental parameters will also vary depending on the contents in the bottle. Therefore, in a preferred embodiment, a communication link, such as wireless link 260 (or a wired link, not shown) may be used to establish communication with a smart phone, tablet, PC, etc. or other external device to enable programming of possible formula contents and algorithms into controller 200. The desired formula actually installed in the compartment may then be selected by using the Formula selector (213, 113) in conjunction with LCD display (211, 111). It is also within the scope of the invention to include one or more "non-mixed" formula settings, to allow the Monitor of the instant invention to be used also in cases where it is not intended to mix ingredients, a common example being when it is desired to place pure breast milk in the bottle without any additional formula supplement. In such case, formula selector (213, 113) is set to indicate the "breast milk" non-formula setting, and immediately after filling bottle 103 with breast milk, the user presses start button (212, 112) to cause controller 200 to begin monitoring environmental conditions in the same fashion as in the mixing case, except using a different spoilage calculation corresponding to the different ingredient in the bottle.

The user interface may include an additional button or other means to lock the settings of the buttons to prevent accidental actuation (especially by a baby). For example, pressing a particular combination of the buttons already disclosed in the preferred embodiment may cause a visual or audible signal to the user that the buttons are locked. Further actuation of the buttons then will have no effect on the previously-described operation of the device until the device becomes unlocked by actuating another particular combination of the buttons or by actuating an unlocking button (not shown).

For embodiments that include wireless link 260 capable of communicating with an external computer, smart phone or other external device, the user may want to authorize uploading of operating parameters from controller 200, either in real time or in batch, in order to monitor the operation of the mixing device. For example, when the controller switches from "active" mode to "nearly spoiled" or to "spoiled", the controller can also issue an alarm to the external device to indicate a change in status. As a further example, if a tilt or other "bottle position" sensor (not shown) is included in the device, the controller can monitor whether the baby is properly holding the bottle, and issue an alarm and/or send a signal to the external device in case the bottle is not positioned properly. The controller can also send data corresponding to the various sensors (e.g., temperature, pH, etc.) to the external device.

Other information may be communicated between the mixing device and an external device. The mixing device may be equipped with a sensor capable of measuring the volume of mixed liquid, and send this data to the external device, along with alarms when the level of remaining liquid runs low. The controller may also monitor the overall consumption of liquid just by counting the number of uses, and may send these or other cumulative statistics to the external device. Additionally, the controller, either by itself, or in conjunction with an app running on the external device, may keep track of the frequency of usage, and issue alarms if too much time has passed since the previous feeding of the baby or if the baby has received either too little or too much feeding. The monitoring and data sent by the controller may also include the composition of the formula and liquid within the mixing device, so that the controller and/or external device may keep track of the overall nutritional content that a baby is receiving. The app running on the external device may receive identifying data such as a serial number from the mixing device to keep track of which device is sending the data in case several such mixing devices are available for use. The mixing device may be programmed to allow the user to identify which baby is receiving the mixture, and this data may be automatically transmitted to the external device to enable the app to keep track of consumption when a plurality of babies can be fed by the mixing devices.

In another embodiment, the mixing device of the instant invention may include programming to actuate audible and/or visual indicators (e.g., sound generator 230, indicator 215) or other audible and/or visual indicators (not shown) in order to sooth a baby while consuming the mixed contents, or to be used in other situations such as to keep a baby's attention times other than when being used for feeding.

The above description and appended drawings show only preferred embodiments of the present invention, and not all of the numerous variations and modifications that will become apparent to those skilled in the art of designing electronic consumer products, after having benefit of reading the disclosed invention. For example, but not by way of limitation, although only one compartment is described for holding powdered formula, there may be multiple compartments and multiple seals corresponding to seal 106, if it is desired to keep multiple ingredients in isolation prior to use, and the controller may actuate the multiple seals according to a timed sequence so that the components be mixed in succession according to a mixing algorithm. Also, although the Mixing and Spoilage Monitor of the instant invention has been described in the context of a ring that is installed on a conventional baby bottle, it is also within the scope of the invention to have the active parts of the device installed as integral elements of a baby bottle container itself, either disposed near the top of the bottle or at the bottom (or anywhere else along the bottle, or distributed at multiple positions throughout the bottle). Some examples of possible variations in design of mixing chambers that could be used in the present invention may be found in the documents listed in the background section. To use these designs with the present invention, it is only necessary to include a switch 216 to be actuated when the seals are broken, or alternatively, to add motor 240 and appropriate linkage to cause the seals to be broken in response to the user pressing an electrical switch.

Further, some or all of the electronic components, such as Controller 200, User Interface 210, etc. may be placed in a removable module that may be removed from the remainder of the device prior to washing the device after use. Moreover, although the description has focused on the application for baby bottles, it is obviously within the scope of the invention to use this for any container (can, bottle, jug, etc.) or portion thereof, wherein it is desired to maintain two or more ingredients in isolation prior to use, and then to track the spoilage point once mixed, possibly based in part on environmental exposure. Thus, many variations to the preferred embodiments presented as examples in this specification are possible, so that the scope of the instant invention should be limited only by the subject matter covered in the claims appended herewith.

I claim:

1. A device for holding and mixing perishable products while providing anti-spoilage monitoring, said device comprising:

at least a portion of a container;

a compartment capable of holding a material desired to be mixed with a liquid prior to use;

a seal for maintaining said material within said compartment prior to use;

an actuating element causing said seal to open using one of a direct mechanical connection and an electrical actuation of a motor, and said material to become in mutual association with said liquid, thereby forming mixed contents within said container; and a controller configured to receive a signal responsive to one or more of said actuating element and a start/stop button indicating commencement of mixing, initiate a timer, perform a calculation on a recurring basis as to the degree of spoilage of the mixed contents in part based on the status of said timer, and actuate an alarm when the calculation determines that the mixed contents have reached a spoilage condition.

2. The device of claim 1, further comprising at least one sensor capable of generating a signal based on a characteristic parameter of the mixed contents, and wherein the calculation of the degree of spoilage is based in part on the timer and in part on the signal corresponding to the characteristic parameter.

3. The device of claim 2, wherein the characteristic parameter corresponds to at least one of the following parameters: the temperature of the container contents, the ambient temperature surrounding the container, the chemical composition of the mixed contents, the pH of the mixed contents, the ambient light level.

4. The device of claim 1, wherein said seal comprises at least one of a valve and a frangible element.

5. The device of claim 1, wherein said controller has the capacity to be programmed to calculate spoilage based on a plurality of spoilage algorithms, and the desired algorithm to be used may be selected by the user.

6. The device of claim 5, wherein at least one of said spoilage algorithms may be installed in said controller by means of an external device and a communication link.

7. The device of claim 5, wherein at least one of said spoilage algorithms corresponds to a "non-mixed" setting.

8. The device of claim 1, wherein said step of actuating an alarm comprises sending a coded signal to an external device through a communication link.

9. The device of claim 1, wherein said controller can send information pertaining to operating parameters and cumulative statistics to an external device through a communication link.

10. The device of claim 1, wherein said container comprises a baby bottle.

11. The device of claim 1, wherein said portion of a container comprises a ring that may be assembled along with a container base to form a baby bottle.

12. A device to enable holding and mixing of perishable food products while providing anti-spoilage monitoring, and which can be attached to a baby bottle or portion thereof, said device further comprising:

a compartment capable of holding a material desired to be mixed with a liquid prior to use;

a seal for maintaining said material within said compartment and said liquid in said baby bottle prior to use;

an actuating element causing said seal to open using one of a direct mechanical connection and an electrical actuation of a motor, and said material to become in mutual association with said liquid, thereby forming mixed contents within said baby bottle; and a controller configured to receive a signal responsive to one or more of said actuating element and a start/stop button indicating commencement of mixing, initiate a timer, perform a calculation on a recurring basis as to the degree of spoilage of the mixed contents in part based on the status of said timer, and actuate an alarm when the calculation determines that the mixed contents have reached a spoilage condition.

13. The device of claim 12, further comprising at least one sensor capable of generating a signal based on a characteristic parameter of the mixed contents, and wherein the calculation of the degree of spoilage is based in part on the timer and in part on the signal corresponding to the characteristic parameter.

14. The device of claim 13, wherein the characteristic parameter corresponds to at least one of the following parameters: the temperature of the container contents, the ambient temperature surrounding the container, the chemical composition of the mixed contents, the pH of the mixed contents, the ambient light level.

15. The device of claim 12, wherein said seal comprises at least one of a valve and a frangible element.

16. The device of claim 12, wherein said controller has the capacity to be programmed to calculate spoilage based on a plurality of spoilage algorithms, and the desired algorithm to be used may be selected by the user.

17. The device of claim 16, wherein at least one of said spoilage algorithms may be installed in said controller by means of an external device and a communication link.

18. The device of claim 16, wherein at least one of said spoilage algorithms corresponds to a "non-mixed" setting.

19. The device of claim 12, wherein said step of actuating an alarm comprises sending a coded signal to an external device through a communication link.

20. The device of claim 12, wherein said controller can send information pertaining to operating parameters and cumulative statistics to an external device through a communication link.

21. A method for holding and mixing perishable products while providing anti-spoilage monitoring, said method comprising:

providing a compartment capable of holding material desired to be mixed with a liquid prior to use;

providing a seal for maintaining said material within said compartment prior to use;

providing an actuating element which can cause said seal to open using one of a direct mechanical connection and an electrical actuation of a motor, and said material to become in mutual association with said liquid to be mixed, thereby forming mixed contents; and providing a controller configured to receive a signal responsive to one or more of said actuating element and a start/stop button indicating commencement of mixing, initiate a timer, perform a calculation on a recurring basis as to the degree of spoilage of the mixed contents in part based on the status of said timer, and actuate an alarm when the calculation determines that the mixed contents have reached a spoilage condition.

* * * * *